US006077090A

United States Patent [19]

Campbell et al.

[11] Patent Number: 6,077,090

[45] Date of Patent: Jun. 20, 2000

[54] FLEXIBLE CIRCUIT CONNECTOR WITH FLOATING ALIGNMENT FRAME

[75] Inventors: Jeffrey Scott Campbell, Binghamton; James Thomas Holton, Endwell, both of N.Y.

[73] Assignee: International Business Machines Corporation, Armonk, N.Y.

[21] Appl. No.: 08/872,465

[22] Filed: Jun. 10, 1997

[51] Int. Cl.[7] ..... H01R 12/00

[52] U.S. Cl. ..... 439/67; 439/77

[58] Field of Search ..... 439/67, 77, 493, 439/496

[56] References Cited

U.S. PATENT DOCUMENTS

| | | | |
|---|---|---|---|
| Re. 34,190 | 3/1993 | Rubinstein | 439/67 |
| 3,065,445 | 11/1962 | Crimmins | 439/496 |
| 3,079,579 | 2/1963 | Crimmins et al. | 439/496 |
| 4,895,523 | 1/1990 | Morrison et al. | 439/67 |
| 4,902,234 | 2/1990 | Brodsky et al. | 439/67 |
| 4,907,975 | 3/1990 | Dranchak et al. | 439/67 |
| 4,911,643 | 3/1990 | Perry et al. | 439/67 |
| 4,969,824 | 11/1990 | Casciotti | 439/67 |
| 5,026,291 | 6/1991 | David | 439/67 |
| 5,059,129 | 10/1991 | Brodsky et al. | 439/67 |
| 5,099,393 | 3/1992 | Bentlage et al. | 439/67 |
| 5,102,342 | 4/1992 | Marian | 439/65 |
| 5,171,154 | 12/1992 | Casciotti et al. | 439/67 |
| 5,228,863 | 7/1993 | Campbell et al. | 439/67 |
| 5,298,685 | 3/1994 | Bindra et al. | 170/250 |
| 5,458,506 | 10/1995 | Yamaguchi et al. | 439/67 |
| 5,466,162 | 11/1995 | Schroepfer et al. | 439/67 |
| 5,486,114 | 1/1996 | Soes et al. | 439/62 |
| 5,496,182 | 3/1996 | Yasumura | 439/62 |

OTHER PUBLICATIONS

IBM Technical Disclosure Bulletin, "High–Density Flexible Circuit Connector", vol. 33, No. 5, pp. 181–184. Oct. 1990.

IBM Technical Disclosure Bulletin, "High Density, Low Cost Board–To–Card Connector", vol. 32, No. 9B, pp. 358–359. Feb. 1990.

*Primary Examiner*—Paula Bradley
*Assistant Examiner*—Briggitte R. Hammond
*Attorney, Agent, or Firm*—William N. Hogg

[57] ABSTRACT

A connection device interconnecting a pair of circuit cards or circuit boards or circuit card to a circuit board is provided for connecting the circuitry on one of the cards or boards to the circuitry on the other of the cards or boards and wherein each of the cards and/or boards has contact pads. The circuit device includes a sheet of flexible circuit having a first and a second end, and a first set of contacts arranged to correspond to the contact pads on one of said circuit boards or cards and a second set of contacts arranged to contact the contact pads on the other card or board. Circuit traces connect the first and second contacts. A flexible circuit support member is provided which includes a body and a frame slidably mounted on said body for movement toward and away from a first face on the body and having an elastomeric member carried thereby. The body also has a second face extending from and substantially normal to the first face, with an elastomeric member mounted thereon. The flexible circuit is carried by the frame and the second face. The first end of the flexible circuit terminates on the surface of the frame spaced from the terminate edge thereof, preferably by a lip extending along the terminate edge of the face. Fasteners interconnect the boards or cards to the connection device.

11 Claims, 3 Drawing Sheets

FLEXIBLE CIRCUIT CONNECTOR WITH FLOATING ALIGNMENT FRAME

FIELD OF THE INVENTION

This invention relates generally to the interconnection of two circuit boards or circuit cards with a connector device utilizing flexible circuit technology. In more particular aspects, this invention relates to a connection device connecting two circuit boards or cards utilizing flexible circuit technology where the flexible circuit is precisely aligned and has the edge thereof protected against damage.

BACKGROUND OF THE INVENTION

There are many instances where a circuit card or circuit board must be connected to another circuit card or circuit board in computer and related technology. One technique for making such interconnection utilizes flexible circuit for such connections. Such a technique is shown and described in commonly assigned U.S. Pat. No. 5,228,863, dated Jul. 20, 1993, and which is incorporated herein by reference. As the technology for flexible circuit cards and boards advances, the connection pads on the boards and cards are becoming smaller and smaller and more closely spaced, and thus require precise alignment with essentially uniformly-distributed pressure. Such precise alignment and uniformly-distributed pressure is especially desirable where the connection to one of the boards is to be done in a factory or manufacturing environment wherein fixturing or similar devices can be used to obtain the precise alignment to one of the boards or cards, but wherein the connection of this board or card to the other card or board is to be made in the field, and thus requires a certain amount of tolerance variation and allowance for connection.

Moreover, it has become increasingly necessary to protect the edges or ends of the flexible circuit from damage during transportation and insertion for field installation to thereby ensure a proper connection to the appropriate contacts. In the past, edge damage of the flexible circuit used in making the connection in the field has resulted in damage to the flexible circuit and consequent unsatisfactory connections being made in the field.

SUMMARY OF THE INVENTION

According to the present invention, a connection device interconnecting a pair of circuit cards or circuit boards or circuit card to a circuit board is provided for connecting the circuitry on one of the cards or boards to the circuitry on the other of the cards or boards and wherein each of the cards and/or boards has contact pads. The circuit device includes a sheet of flexible circuit having a first and a second end, and having a first set of contacts arranged to correspond to the contact pads on one of said circuit boards or cards and a second set of contacts arranged to contact the contact pads on the other card or board and circuit traces connecting the first and second contacts. A flexible circuit support member is provided which includes a body and a frame slidably mounted on said body for movement toward and away from a first face on the body and having an elastomeric member carried thereby. The body also has a second face extending from and substantially normal to the first face, preferably with an elastomeric member mounted thereon. The flexible circuit is carried by the frame and the second face. The first end of the flexible circuit terminates on the surface of the frame spaced from the terminate edge thereof, preferably by a lip extending along the terminate edge of the face. Fasteners interconnect the boards or cards to the connection device, maintaining the flexible circuit in contact with the pads on the boards and cards.

DESCRIPTION OF THE PREFERRED EMBODIMENTS

Figure 1:
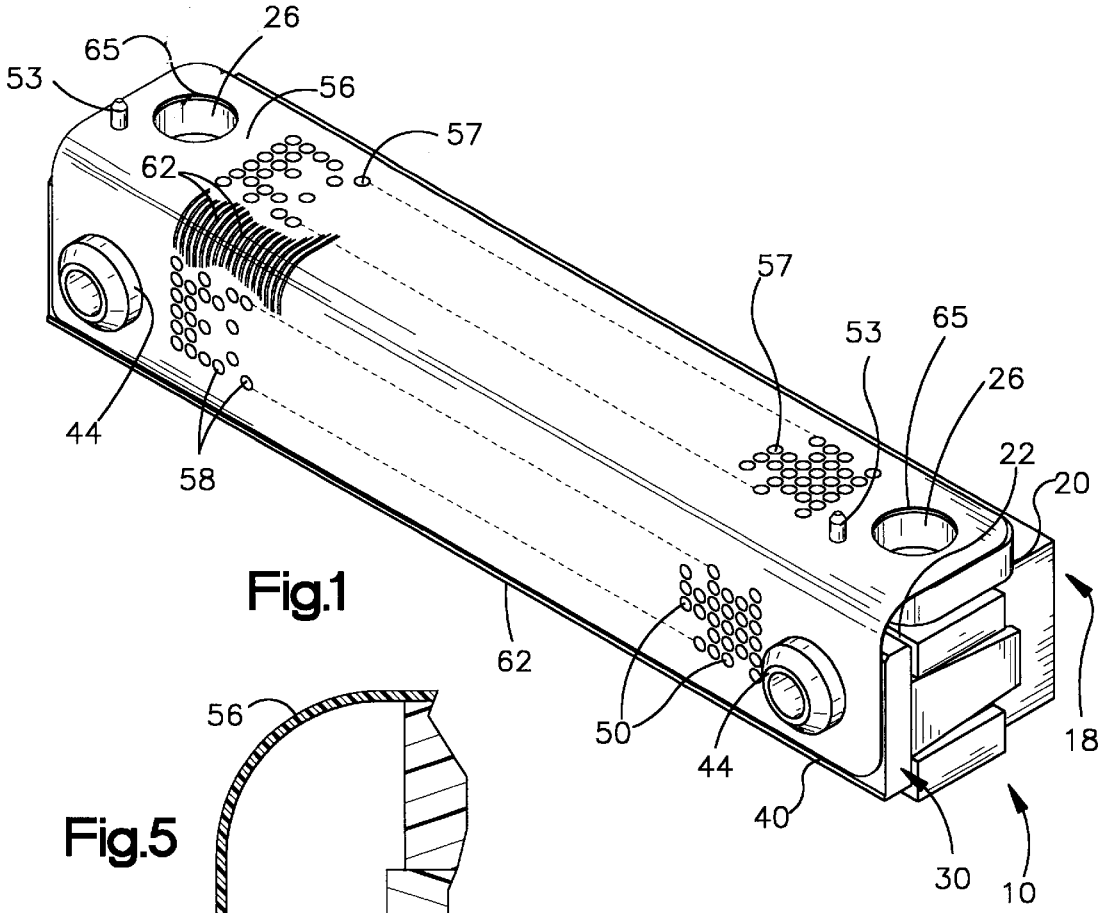
FIG. 1 is a perspective view of a connection device according to this invention for use in connecting a pair of circuit cards or circuit boards.
Figure 2:
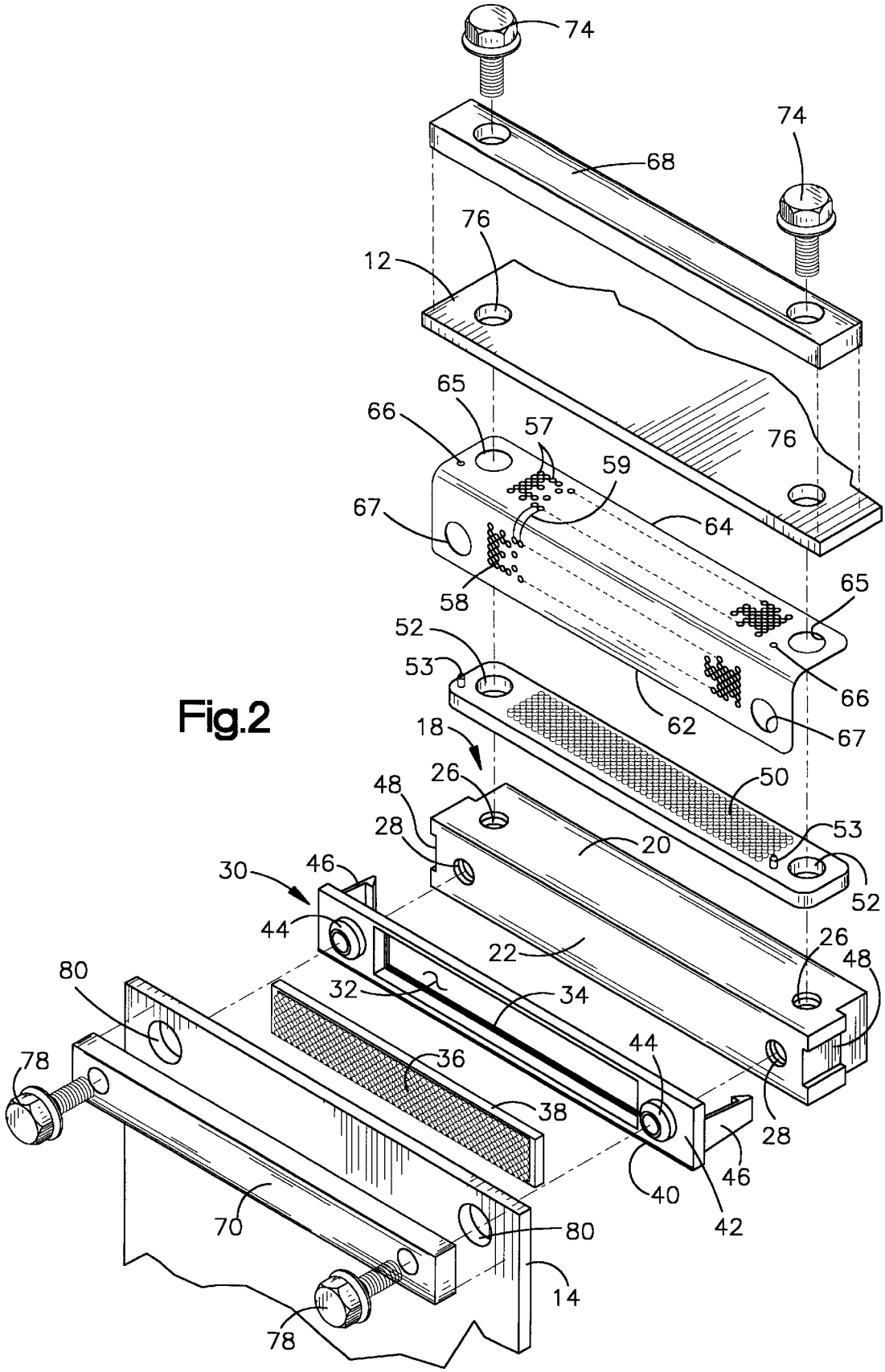
FIG. 2 is a perspective exploded view with parts removed for clarity of the device of FIG. 1 shown in position connecting a circuit card to a circuit board.

Referring now to the drawings, and for the present to FIGS. 1 and 2, a connection or connector device generally designated as 10 is shown for connecting a circuit card 12 to a circuit board 14. (As used herein, the terms "card" and "board" are used interchangeably since the present invention can be used to connect two circuit cards or two circuit boards or a circuit card to a circuit board. However, for convenience of reference and description, the term "card" is used for one of the substrates being connected and the term "board" is being used for the other. Also, the invention will be described as the device being assembled in the factory to the card 12 and then the card and device assembled in the field to the board 14. However, this is merely for convenience sake and it should be understood that the invention is applicable to connecting two substrates which can take the form of two cards, two boards or a circuit card and a circuit board or the like.)

The connection device 10 includes a body, designated generally as 18, having elastomeric support face 20 and a frame support face 22. Threaded openings 26 extend into the body 18 from the elastomeric support face 20, and bottomed threaded bores 28 extend partially into the body 18 from the frame support face 22.

A floating frame member, designated generally as 30, is provided which has a central opening 32 therein surrounded by a raised rim 34. An elastomeric insert unit 36 is provided, the structure of which will be described presently. The elastomeric insert unit 36 has a relatively rigid ridge 38 extending therearound, disposed to coact with the rim 34 and locate the elastomeric insert 36 within the central opening 32 when it is placed within the opening 32 of the floating frame 30. The floating frame 30 also has a lip 40 formed along the marginal edge of face 42 of the floating frame member 30. A pair of hollow pins 44 extend outwardly from opposite sides of the face 42 which are used to align the flexible circuit with the connector and the circuit board 14. The frame member 30 also has a pair of ears 46 which extend from the opposite sides thereof and are positioned to mate with slots 48 formed in the body 18. The fit of the ears 46 in the slots 48 is a rather loose fit, thus allowing some movement of the frame member 30 with respect to the body 18 to allow alignment as will be described presently.

An elastomeric cushion 50 is provided which is slidably mounted on the elastomeric support face 20 of the body 18. Openings 52 are provided on opposite ends of the elastomeric cushion 50 which align with the openings 26 in the body 18. Pins 53 are also provided at opposite ends of the cushion 50.

Figure 4:
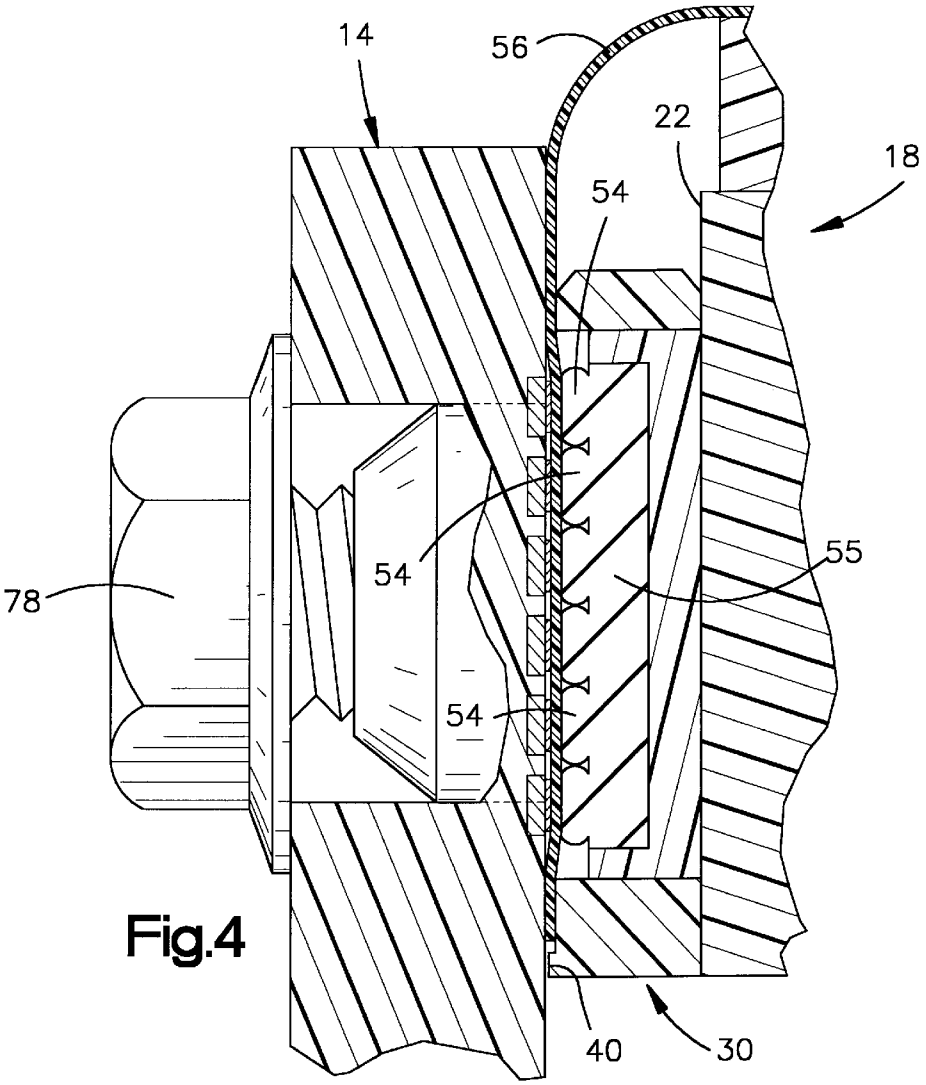
FIG. 4 is a view similar to FIG. 3 showing the connection device connected to a circuit board.
Figure 3:
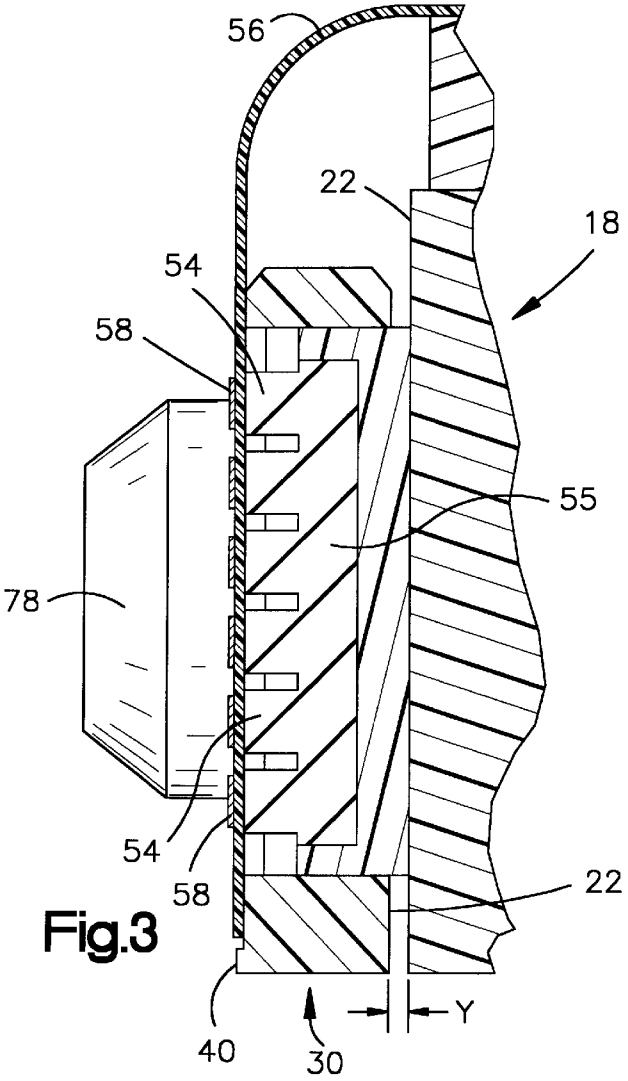
FIG. 3 is a longitudinal sectional view of a portion of the connection device showing the floating frame member in position for connection to a card before connection thereto.

As can best be seen in FIGS. 3 and 4, the elastomeric unit 36 is formed of a plurality of elastomeric columns 54 extending outwardly from an elastomeric base 55. The material used to form this elastomer preferably is silicone rubber. This will allow for a squeezing or controlled compression of the elastomer to provide a desired uniform pressure for forming contacts, as will be described presently.

A sheet of flexible circuit 56 is provided which has contacts 57 thereon adapted to mate with contact pads (not shown) on card 12 and contacts 58 thereon adapted to mate with contact pads (not shown) on circuit board 14. Circuit traces 59 connect the contact 57 and 58 in a well-known manner. The flexible circuit 56 has spaced opposite ends 62 and 64 adjacent which the contacts 57 and 58, respectively, are located.

The flexible circuit also has openings 65 which align with the openings 52, openings 66 that align with pins 53, and openings 67 which align with the hollow pins 44. The card 12 is preferably provided with a stiffener 68 and the board 14 is preferably provided with stiffener 70, both of which have openings (unnumbered). Screws 74 are provided to connect the connection device 10 to the card 12 through openings 76 on the card 12, and screws 78 are provided to connect the connection device 10 to the circuit board 14 through openings 80 in the board 14.

The connection of connector device 10, the circuit card 12 and circuit board 14 is made in the following manner. The connection unit device 10 is assembled by placing the elastomeric insert unit 36 in the central opening 32 of floating frame 30, with the rim 34 engaging the ridge 38. The floating frame 30 is then mounted on the body 18 with the ears 46 inserted in the slots 48. The elastomer cushion 50 is then placed on the face 20 of the body 18, with the openings 52 aligned with the openings 26. The flexible circuit 56 is then placed onto the floating frame 30 by means of the hollow pins 44 extending through the openings 67 of flexible circuit 56.

The flexible circuit 56 is then folded over so that the openings 65 align with the openings 52 in the elastomeric cushion 50 with pins 53 engaging openings 66 in flexible circuit 56. The flexible circuit 56 is secured to the face 42 of the floating frame 30 with end 62 thereof abutting against the lip 40 on the face 42. The flexible circuit 56 is adhered to the face 42 preferably using an acrylic adhesive (not shown), although other adhesives may be employed. The purpose of the lip 40 is to prevent the end 62 of the flexible circuit 56 from being damaged during connection of the card 14 and connection device 10 to the board 14, as will be explained presently. The thickness of the flexible circuit is generally about 0.004 inch, and it is thus preferable that the lip 40 have a height above face 42 of less than about 0.004 inch. Of course, if the flexible circuit has a different thickness, all that is required is that the lip have a height less than the thickness of the flexible circuit.

With the flexible circuit 56 so adhered to the floating frame 30, the circuit card 12 is positioned with the holes 76 aligned with the openings 56 in the flexible circuit and the openings (unnumbered) in stiffener 68, and screws 74 are threaded into the openings 26 in the body 18, through the openings 52 in the elastomeric cushion 50, openings 65 in the flexible circuit 56, and the openings (unnumbered) in the stiffener 68. The screws 74 are tightened down, and the sliding movement of the elastomeric cushion 50 on face 20 of body 18 allows for alignment of the contacts 57 on the flexible circuit 56 with the contacts on the card 12. As described previously, this is normally a factory assembly or manufacturing assembly operation done under relatively controlled conditions, conventionally done with a fixture or the like so that precise alignment of the card 12 and the flexible circuit 56 can be obtained by movement of the elastomeric cushion 50.

In this condition, i.e., the connection device 10 with the card 12 attached thereto is adapted to be assembled with a circuit board 14 which, as described above, typically will be a field assembly operation. As can be seen in FIG. 3, the elastomeric columns 54 are fully extended against the rear of the flexible circuit 56, thus urging the floating frame 30 away from the frame support face 22 of the body 18, leaving a space shown as Y in FIG. 3 between the frame support face 22 and the flexible frame 30. In this assembly operation, the connection device 10 with the card 12 attached thereto is brought together with the circuit board 14 with the hollow pins 44 in alignment with the openings 80 in the board 14. The hollow pins 44 are passed through the openings 80 in board 14, which will result in a very light contact of the contacts 58 on the flexible circuit 56 coming into contact with the contacts (not shown) on the board 14. The action of the hollow pins 44 in the openings 80 will cause the flexible frame 30 to move into position with the contacts 58 aligned with the contacts on the board 14 by virtue of the limited movement of the frame 30 permitted by the ears 46 having a relatively loose fit in slots 48. This position is shown in FIG. 3.

When the screws 78 are screwed through the hollow pins 44, they will engage the bottom threaded bores 28 in the body 18, drawing the circuit board 14 into tight contact with the flexible circuit 56, and the contacts 58 on the flexible circuit. Continued tightening of the screws will move the flexible frame 30 toward the face 22 of the body 18 until the flexible frame comes into contact with the face 22 as shown in FIG. 4. This will result in the elastomeric columns 54 pressing and bulging as shown in FIG. 4, thus supplying a uniform consistent pressure to the contacts 58, urging them against the circuit board 14.

As indicated earlier, during this assembly operation, the lip 40 protects the end 62 of the flexible circuit 56 from potential damage during this field installation of the circuit card to a circuit board.

Figure 5:
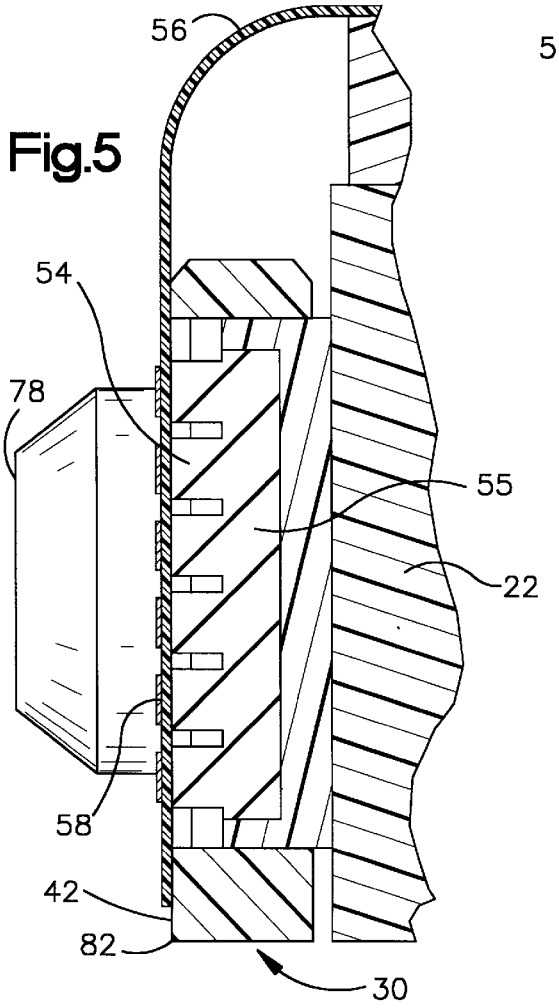
FIG. 5 is a longitudinal sectional view of another embodiment of the present invention similar to FIG. 3.

Referring now to FIG. 5, another embodiment of the invention is shown, wherein the face 42 of the floating frame 30 does not have a lip on the terminal edge thereof. In this embodiment, the end 62 of the flexible circuit 56 is adhesively adhered to the face 42 in a spaced relationship from terminal edge 82 thereof. While this configuration does not provide as much protection for the flexible circuit as is provided in the previous embodiment, the spacing does provide some protection against it being damaged during installation.

Accordingly, the preferred embodiments of the present invention have been described. With the foregoing description in mind, however, it is understood that this description is made only by way of example, that the invention is not limited to the particular embodiments described herein, and that various rearrangements, modifications, and substitutions may be implemented without departing from the true spirit of the invention as hereinafter claimed.

What is claimed is:

1. A connection device for connecting the circuitry on a first substrate having a first set of contact pads to circuitry on a second substrate having a second set of contact pads, comprising:

a sheet ot flexible circuit having a first end and a second end and having a first set of contacts arranged to correspond to said first set of contact pads and a second set of contacts arranged to correspond to said second set of contact pads, and circuit traces connecting said first and second contacts, a body, a frame slidably mounted on said body for movement toward and away from a first face on said body, said body having a second face extending from and substantially normal to said first face, said frame having a circuit mounting face terminating at a distal edge, said flexible circuit being carried by said frame and said second face, said first end of said flexible circuit lying on said circuit mounting face and spaced from said distal edge and a raised lip extending above said circuit engaging face of said frame at said distal edge.

2. The invention as defined in claim 1 wherein an elastomeric member defines at least a portion of said second face on said body.

3. The invention as defined in claim 1 further characterized by at least one biasing member urging said frame away from said body.

4. The invention as defined in claim 3 wherein said biasing member is an elastomeric member insert within said frame.

5. The invention as defined in claim 3 wherein said biasing member includes an elastomeric cushion.

6. The invention as defined in claim 5 wherein said elastomeric cushion includes a plurality of individually compressible elements.

7. The invention as defined in claim 1 further characterized by said frame and said body having interacting members to guide said frame on said body.

8. The invention as defined in claim 7 wherein said interacting members include ears and slots in which said ears are slidably mounted.

9. The invention as defined in claim 8 wherein said ears are on said frame and said slots are on said body.

10. The invention as defined in claim 1 wherein said second face of said body includes an elastomeric member.

11. The invention as defined in claim 10 wherein said frame member includes an elastomeric member defining a portion of said circuit engaging face.

* * * * *